US007597652B2

(12) United States Patent
Walker et al.

(10) Patent No.: US 7,597,652 B2
(45) Date of Patent: Oct. 6, 2009

(54) HYDROTHERAPY MOUNTING APPARATUS AND EXERCISE SYSTEM

(75) Inventors: Victor Lee Walker, Murrietta, CA (US); Angelo Vito Pugliese, Jr., Vista, CA (US); James Donald McClure, Jr., Solana Beach, CA (US)

(73) Assignee: Dimension One Spas, Vista, CA (US)

( * ) Notice: Subject to any disclaimer, the term of this patent is extended or adjusted under 35 U.S.C. 154(b) by 1304 days.

(21) Appl. No.: 10/211,078

(22) Filed: Aug. 1, 2002

(65) Prior Publication Data

US 2003/0100411 A1 May 29, 2003

Related U.S. Application Data

(60) Provisional application No. 60/334,223, filed on Nov. 28, 2001.

(51) Int. Cl.
*A63B 22/00* (2006.01)
*A63B 69/06* (2006.01)

(52) U.S. Cl. ..... 482/51; 482/72; 4/576.1

(58) Field of Classification Search ..... 482/55–56, 482/72, 51; 4/571.1, 572.1, 573.1, 574.1, 4/575.1, 576.1, 577
See application file for complete search history.

(56) References Cited

U.S. PATENT DOCUMENTS 3,028,604 A * 4/1962 Warner ..... 4/576.1
3,065,003 A 11/1962 Whitehouse
3,373,991 A * 3/1968 Smalley ..... 482/55
3,496,577 A * 2/1970 Saldana ..... 4/551
3,534,413 A * 10/1970 Plasseraud ..... 4/492
3,828,714 A 8/1974 Perkins
3,988,020 A 10/1976 Carter
4,149,282 A * 4/1979 Browning ..... 4/577.1
4,218,056 A * 8/1980 Whitling ..... 482/55
4,551,108 A 11/1985 Bass
4,592,686 A 6/1986 Andrews
4,630,982 A 12/1986 Fenner
4,993,343 A 2/1991 Czipri
5,490,823 A 2/1996 Awbrey et al.
5,546,616 A * 8/1996 Bloemer et al. ..... 4/541.2
5,554,091 A * 9/1996 Patey ..... 482/111
5,577,275 A * 11/1996 Guenther ..... 4/576.1
5,823,588 A 10/1998 Morghen
2005/0164842 A1* 7/2005 Quinn ..... 482/55

FOREIGN PATENT DOCUMENTS

GB 2224459 A * 5/1990

* cited by examiner

*Primary Examiner*—Fenn C Matthew
(74) *Attorney, Agent, or Firm*—Catalyst Law Group

(57) ABSTRACT

Systems and techniques to mount equipment in a watertight fashion to a wall. A watertight mount includes a mounting base including a flange and a socket having an interior surface including mating threads. The mount may include a base plate coupled with the mounting base, the base plate defining an opening through which the socket passes. The mount may also include a gasket coupled between the base plate and the mounting base, the gasket defining an opening through which the socket passes, and the base plate may be releasably coupled with the mounting base through a spa wall. The base plate may be coupled with the mounting base using a connector, such as a nut defining a threaded hole that matches securing threads on an exterior surface of a barrel shaped socket in the mounting base.

24 Claims, 22 Drawing Sheets

HYDROTHERAPY MOUNTING APPARATUS AND EXERCISE SYSTEM

CROSS REFERENCE TO RELATED APPLICATIONS

This application claims the benefit of the priority of U.S. Provisional Application Ser. No. 60/334,223, filed Nov. 28, 2001 and entitled "Hydrotherapy Exercise System".

BACKGROUND

The present application describes systems and techniques relating to hydrotherapy exercise systems, for example, a watertight mounting system for use in spa or pool-based exercise equipment.

Traditional hydrotherapy exercise systems include various equipment, such as rowing equipment, designed to be mounted inside a spa or pool. However, these traditional systems use simple mounting and attaching systems that lack versatility. For example, conventional systems for mounting exercise equipment to spas include simple surface mounted devices for attaching a rower. Other conventional systems include a recessed plastic cup that is bonded to the spa wall and a vertical steel rod with a hole through the end to form a simple recessed attachment point.

In traditional hydrotherapy exercise systems, only a single tension cord or piece of equipment can typically be attached at a time to any mounting point. Additionally, the mounting points must typically be placed in the nearly vertical sidewalls to function properly. Because traditional equipment mounting points are fixed in a vertical position, and recessed, they typically limit the methods and types of attachments available, and the orientation of such attachments.

SUMMARY

The present application teaches a watertight mounting system. The watertight mounting system may be used to mount exercise equipment to a wall, such as in a spa, swim spa or pool, to create a flexible and versatile hydrotherapy exercise system or aquatic fitness system. According to an aspect, a watertight mount includes a mounting base including a flange and a socket having an interior surface including mating threads. The mount may include a base plate coupled with the mounting base, the base plate defining an opening through which the socket passes. The mount may also include a gasket coupled between the base plate and the mounting base, the gasket also defining an opening through which the socket passes, and the base plate may be releasably coupled with the mounting base through a spa wall. The base plate may be coupled with the mounting base using a connector. The connector may include four nuts and four mounting screws that pass through the mounting base and the base plate, or the connector may include a nut defining a threaded hole that matches securing threads on an exterior surface of a barrel shaped socket in the mounting base.

DRAWING DESCRIPTIONS

These and other aspects will now be described in detail with reference to the following drawings.

Figure 1:
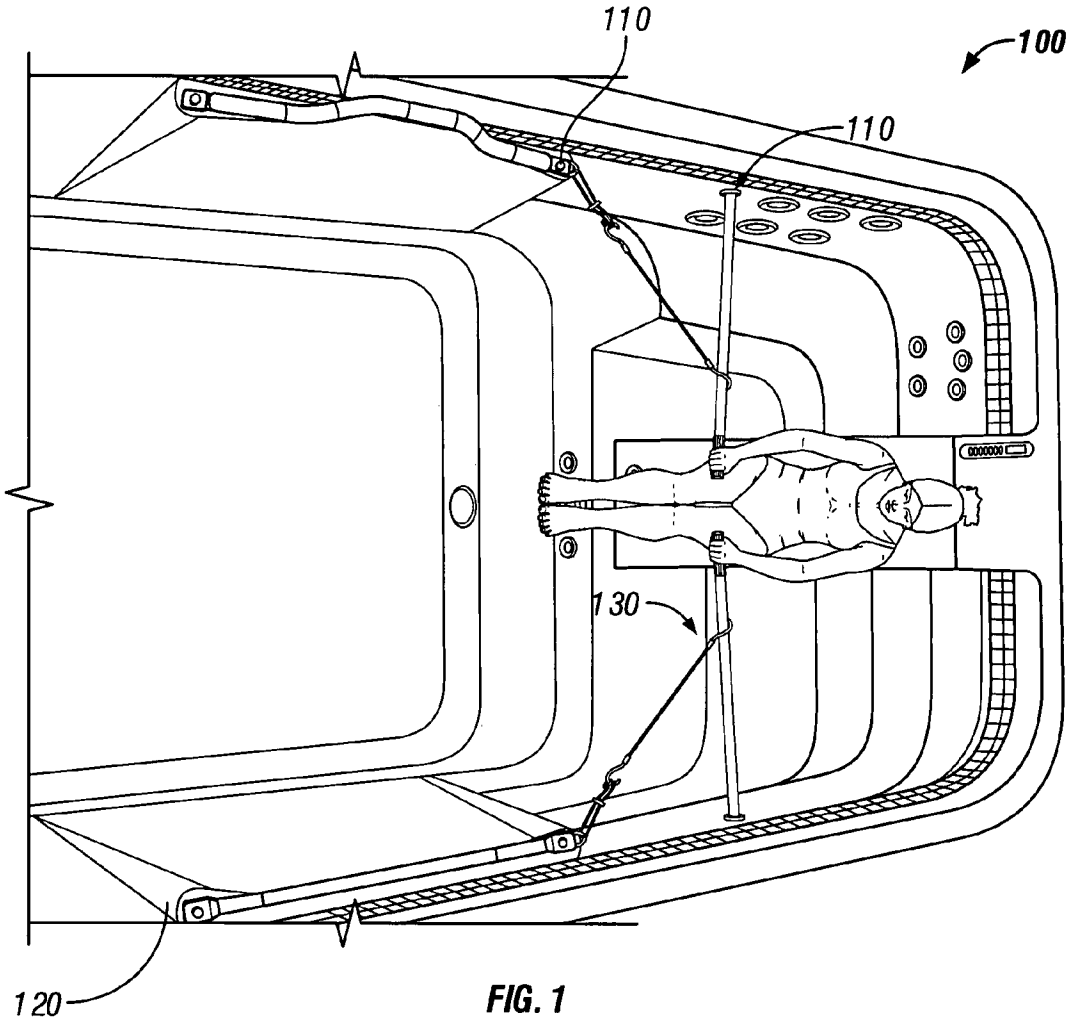
FIG. 1 is an angled view of an example swim spa environment for a hydrotherapy exercise system, including example rowing oar attachments.

Like reference symbols in the various drawings indicate like elements. Details of one or more embodiments are set forth in the description below with the accompanying drawings. Other features and advantages may be apparent from the description and drawings, and from the claims.

DETAILED DESCRIPTION

The systems and techniques described here relate to hydrotherapy exercise systems, such as those used in pools, spas, and swim spas. As used herein, the term "wall" means any partition or panel that includes a surface meant to be impermeable to liquid, such as the wall of a spa, swim spa, or pool. The present inventors recognized that conventional hydrotherapy exercise systems lack flexibility and versatility in their mounting and attachment systems. Accordingly, the inventors developed simple to use, flexible and versatile mounting and attachment systems and techniques for use in hydrotherapy exercise systems.

One or more of the following advantages may be provided. The systems and techniques described can result in watertight orientation-independent mounting of exercise equipment to a spa or pool wall. Such watertight mounting can be performed without tools and with extensive versatility in both types of connectors used and manner of attachment (e.g., fixed or rotational).

The systems and techniques described can result in multi-tether attachment options for multiple exercise attachments, including attachments for rowing and tether exercise generally (including variable resistance configurations). For example, multiple tethers can be attached to rowing oars to create bi-directional positive resistance. Alternatively, one or more tethers can be attached to a watertight mount (e.g., installed at the bottom of a spa) to permit uni-directional positive resistance exercises, Additionally, various exercise bars can be used as fixed handholds (e.g., for stretching or swimming), or as weight training equipment when combined with one or more tethers. These handholds, or similar handholds, may be used where providing access and usability to the physically impaired is desired.

The systems and techniques described can result in hydrotherapy exercise equipment that is non-orientation specific and reversible, free-floating, and ergonomically and biomechanically compatible. These systems and techniques can result in a versatile exercise system having tool-free interchangeable equipment, and multi-use watertight equipment mounts.

For example, connector tops can be used to secure exercise swim bars to mounts, while simultaneously providing one or more anchor points for one or more tethers. The connector tops can include multiple anchors of various sizes and shapes to provide multiple functions. For example, the connector tops may include multiple butterfly loops and/or multiple cloverleaf type hoops (e.g., six hoops) to provide multiple connection points.

Moreover, the connector tops may provide rotational anchors for one or more tethers (e.g., ball and socket, or threaded bolt and nut connection between connector top and mounting base). For example, the mounting base may include a socket with threads included on an interior surface of the socket. The connector top may include a threaded bolt that fits the threads in the mounting base. Thus, this example connector top may be screwed into the mounting base either all-the-way, or part-way, to provide a fixed or rotating anchor point respectively.

Additionally, a connector top may include multiple parts, or multiple connector tops may be used together, to create both fixed and rotating anchor points on the same mounting base. When in the rotating configuration, the mount becomes a free-floating connection point for one or more pieces of exercise equipment. This free-floating configuration may reduce undesirable stresses involved in hydrotherapy exercise.

FIG. 1 is an angled view of an example swim spa environment for a hydrotherapy exercise system, including example rowing oar attachments. A swim spa 100 includes multiple watertight mounts 110. These mounts 110 can be attached to a variety of surfaces, including flat, curved and beveled, both horizontally and vertically. This can be accomplished by changing the configuration and/or shape of the mounting base and/or mount components, including by using form fitting materials such as plastic, rubber or metallic materials to shape the mounting base as needed.

Additionally, the mounts 110 can attach through a surface (e.g., the mount may have a base and gasket on an interior surface of a spa wall and a base plate on an opposite surface of the spa wall) or be embedded in a surface (e.g., the mount may be embedded in a surface defining a pool or spa, such as a pool wall, deck or floor).

The mounts 110 can attach through bolsters, such as a bolster 120, to provide additional flexibility in placement and orientation. A bolster is a protrusion built into the wall. Such protrusions allow flat surfaces to be created at any angle in the wall. Such variably positioned and angled flat surfaces can be of particular use in mounting hydrotherapy exercise equipment in a spa or swim spa. Thus the mounts 110 can be placed at any position or orientation in a swim spa.

The mounts 110 provide anchor points for exercise equipment, such as rowing equipment 130. Moreover, the mounts 110 can receive a series of interchangeable tops that work with exercise and hydrotherapy equipment.

Figure 2:
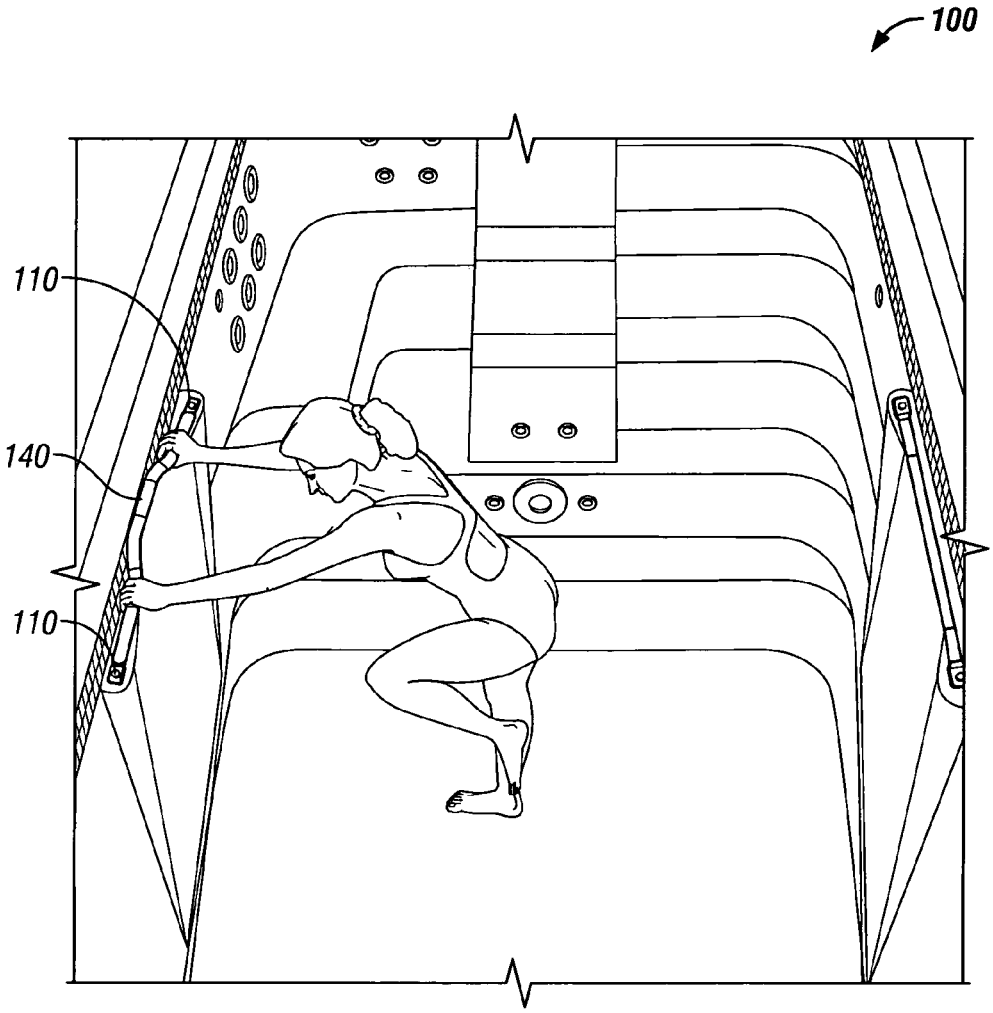
FIG. 2 is an angled view of an example swim spa environment for a hydrotherapy exercise system, including an example exercise bar attachment.

FIG. 2 is an angled view of an example swim spa environment for a hydrotherapy exercise system, including an example exercise bar attachment 140. The interchangeable tops received by the mounts 110 can serve to fix exercise bars, such as the exercise bar 140, to the spa wall and still provide one or more anchors for additional equipment.

The exercise bars can have one or more specialized angles to allow user interaction at various degrees of shell draft in a swim spa environment. The exercise bars may be mounted on bolsters to provide additional space for proper hydrotherapy exercise. Once the bars are in place, the user still has the ability to use resistance-training systems using the versatile mount tops and aquatic fitness bars. The exercise bars are reversible and designed, for example, at 30, 45, and 70-degree angles for a variety of hydrotherapy programs. The bars may also be used to provide access to the pool or spa by the physically impaired.

Figure 3:
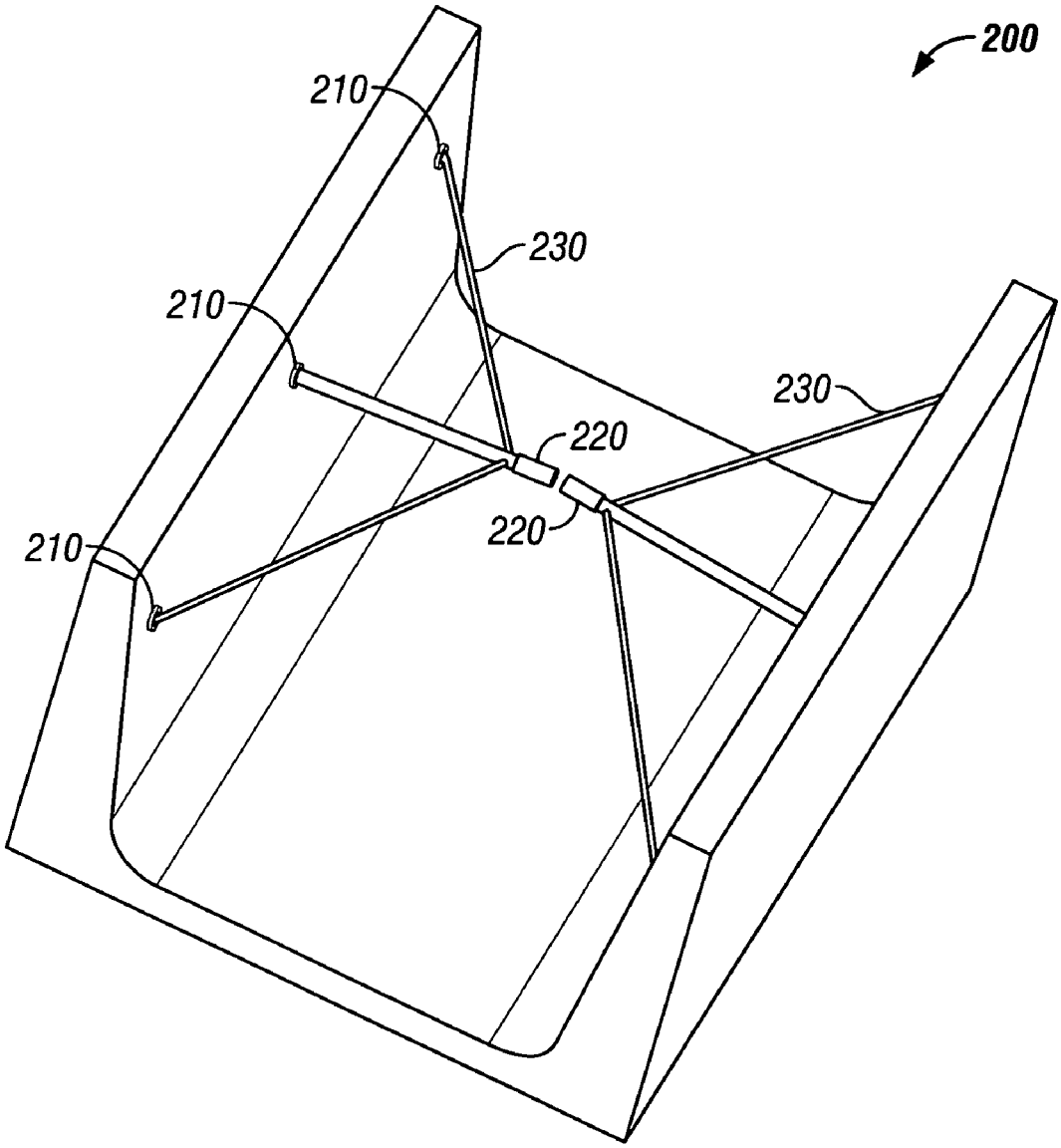
FIG. 3 is a perspective view of an example rowing configuration in an example spa environment.

FIG. 3 is a perspective view of an example rowing configuration in an example spa environment. A spa 200 includes multiple watertight mounts 210. Rowers 220 (e.g., rowing oars, or row bars) can attach to the mounts 210. Tethers 230 can attach to the mounts 210, such as through connector tops described below, and to the rowers 220.

The rowers 220 can be made reversible and allow users to attach the tethers 230 to both sides of a rower for a two-way exercise program (i.e., the user is subjected to both positive and negative resistance in both directions of the rowing exercise). The rowing configuration shown uses two rowers, four tethers and six watertight mounts to create a bi-directional rowing hydrotherapy exercise system.

The rowers 220 can be adjustable in length to accommodate a variety of spa or pool sizes and to accommodate a variety of users. The rowers' adjustability may be implemented using interlocking segments, one or more screw mechanisms, or other pole adjustment systems.

The tethers 230 can be made of a butadiene acrylonitrile material (e.g., Buna N, Nitrile, NBR (Nitrile Buna Rubber)), or other suitable material. The tethers 230 may be entirely made of an elastic material, or the tethers may have an elastic portion and a non-elastic portion. For example, each tether may have an elastic portion made of Buna N, and a non-elastic portion that is adjustable in length. Adjustability of the non-elastic portion can be achieved through hook and loop (e.g., VELCRO®), buckles, or other adjustment systems.

Figure 4:
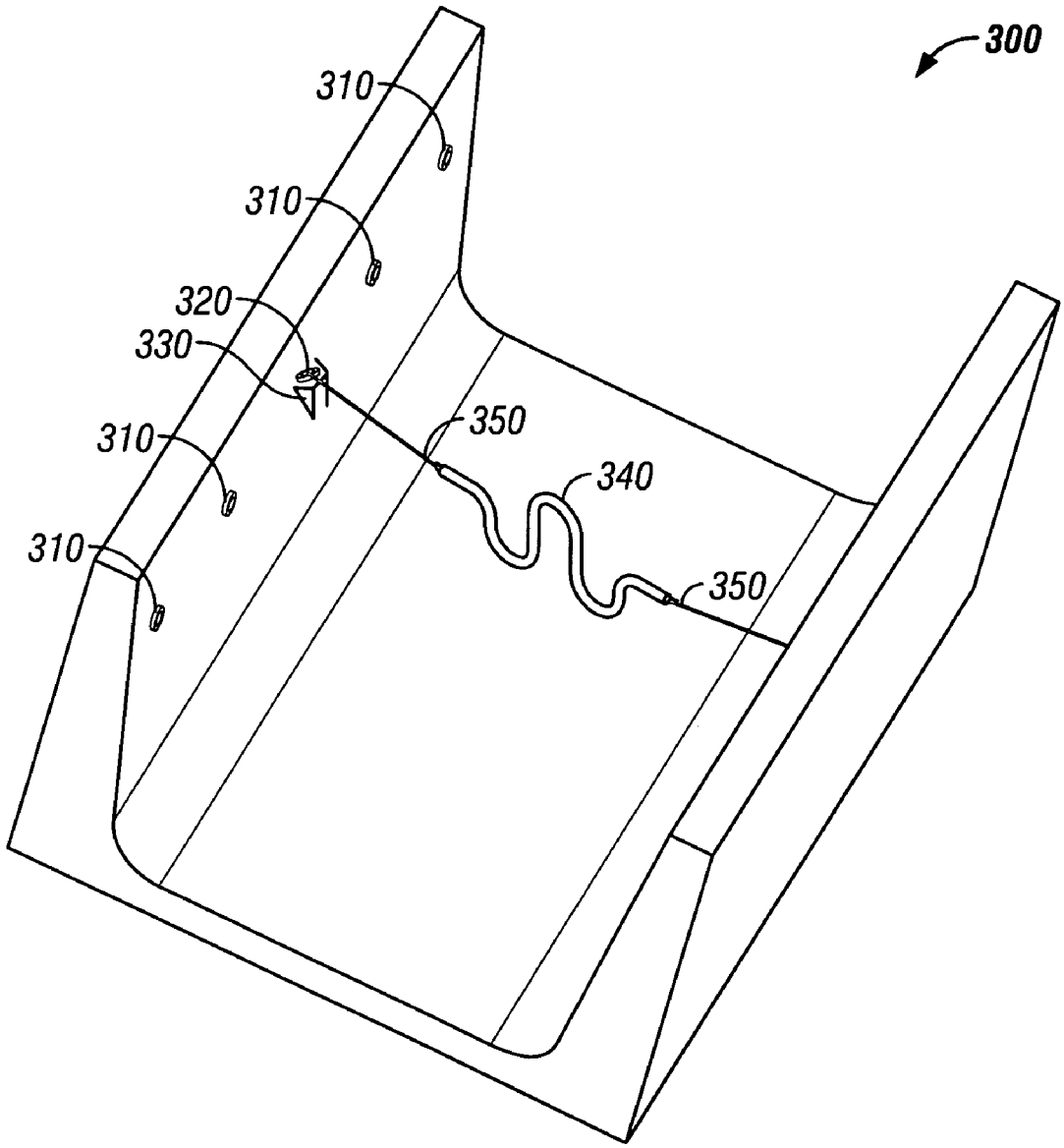
FIG. 4 is a perspective view of an example exercise bar configuration in an example spa environment.

FIG. 4 is a perspective view of an example exercise bar configuration in an example spa environment. A spa 300 includes multiple watertight mounts 310, 320. Multiple exercise bars of various shapes, such as an exercise bar 340, can be provided for use with the mounting system and resistance tethers 350. These exercise bars also can allow for multiple tether attachment in two directions. This allows a work/work condition as opposed to a work/rest condition. The aquatic exercise bars can be used to perform various exercises such as curls, bench press, lifts, etc. The aquatic exercise bars can attach to selectably fixed or rotating anchor points, such as the mount 320, which can be placed on bolsters, such as a bolster 330, in the spa wall including the floor of the spa.

The mounting system may use multiple mounts 310 spaced around a pool or spa in a uniform fashion. For example, a set of side-by-side mounts (either vertically or horizontally or at various angles) may be placed every 12 inches along a spa to create multiple mounting points for multiple length bars of 12, 24 and 36 inches. Uniform spacing of the mounts may be used to provide a universal fit for the various attachment options and to provide maximum flexibility in the number of users and the number and location of exercise equipment attachments.

Figure 5:
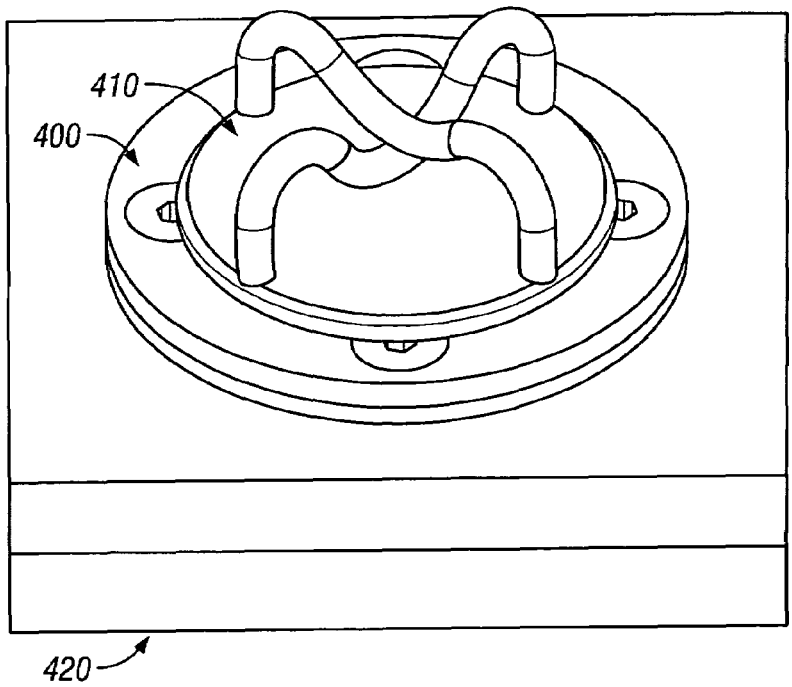
FIG. 5 is a perspective view of an example watertight mount and an example connector top installed in an example spa wall.
Figure 6:
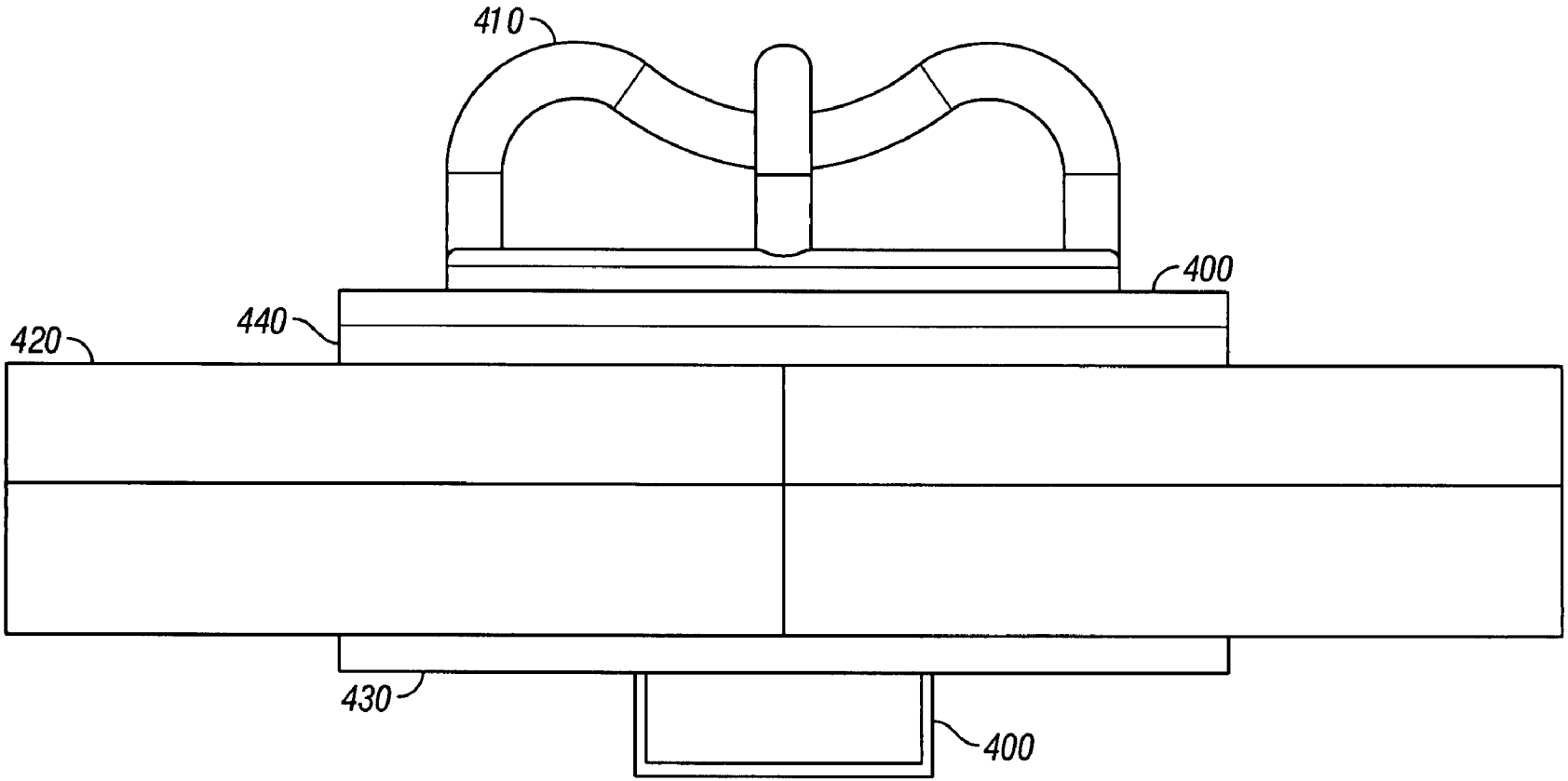
FIG. 6 is a front view of the watertight mount and the connector top from FIG. 5.

FIG. 5 is a perspective view of an example watertight mount 400 and an example connector top 410 installed in an example spa wall 420. FIG. 6 is a front view of the watertight mount 400 and the connector top 410 from FIG. 5. The mount 400 represents a mounting base, which can be a watertight stainless steel base, that can receive the connector top 410 or other equipment. The mount 400 includes a flange, which may be rounded, and a socket, which may be barrel shaped.

The connector top 410 can screw into the mount 400. The connector top 410 can have a single anchor, or multiple anchors. These anchors can have various sizes and shapes to provide multiple functions. Additionally, these anchors may meet or intersect with each other to provide additional attachment versatility.

The example connector top shown can allow multiple tethers to be attached at one time, which allows various levels of resistance and multiple station workouts. For example, two people can exercise at the same time using the example connector top shown, which can allow up to four separate tethers to be attached to a single mount top. Up to four people can simultaneously use this example mount with single tethers. Larger connector tops and/or connector tops with more attachment points are also possible to increase the number of possible simultaneous users of a single mount.

The mount 400 also includes a base plate 430, which can be a stainless steel base plate. Various parts of the mount 400 can be stainless steel, but other materials, such as other metals, plastics, or composite materials are also possible. The stainless steel used can be 304-grade stainless steel.

The base plate 430 may be rounded (e.g., circular or oval shaped), or may be cornered (e.g., square or rectangular). The base plate 430 may also have substantially similar width dimensions as the flange. To be substantially similar, the width dimensions should be sufficiently close to assist in placing the sealing pressure on an outside edge of the flange. Additionally, the flange can have a minimum width dimension of at least about three inches (e.g., two inches or more to three inches or more, depending on the size of the socket) to assist in placing the sealing pressure on an outside edge of the flange.

A connector used to couple the base plate 430 with the mounting base 400 can also be selected to maintain this sealing pressure arrangement. This connector and the size of the flange and the base plate 430 can also be selected to facilitate a parallel condition between the flange and the wall. Moreover, a larger base plate can assist in accounting for any irregularities in a fiber glass reinforcement layer on a spa wall surface opposite an interior surface.

The mount 400 can include a gasket 440. The gasket 440 can be a liquid (e.g., a sealant) or solid gasket. The gasket 440 can be a flexible gasket, such as a gasket made of an ethylene propylene material (e.g., EPR (Ethylene Propylene Rubber), EPT (Ethylene Propylene Terpolymer), EPDM (Ethylene Propylene Diamene Monomer)). Moreover, the gasket 440 can have various shapes and configurations. For example, the gasket 440 may be an O-ring gasket or a double O-ring gasket.

Figure 7:
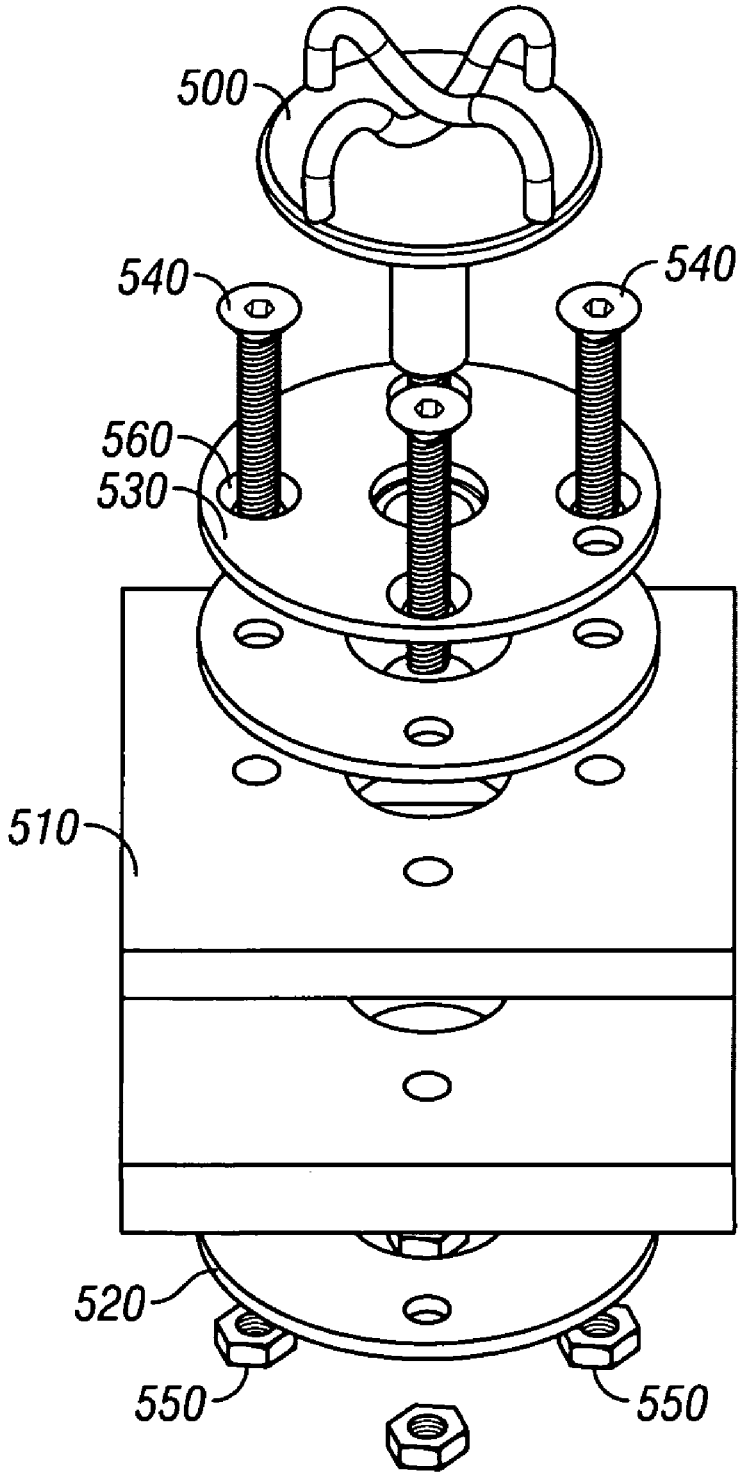
FIG. 7 is an exploded perspective view of an example watertight mount installed in an example spa wall.

FIG. 7 is an exploded perspective view of an example watertight mount installed in an example spa wall 510. The mount includes an example connector top 500. A connector is used to couple a base plate 520 with a mounting base 530. The connector includes four mounting screws 540 and four nuts 550. The screws 540 and nuts 550 can also be stainless steel.

Each screw 540 can include a beveled flat-topped screw head as shown. The mounting base 530 can include openings in the flange, such as an opening 560, that are beveled to match the bevel of the flat-topped screw heads. Additionally, each screw 540 can be a hex screw to enable achievement higher torque value.

Figure 8:
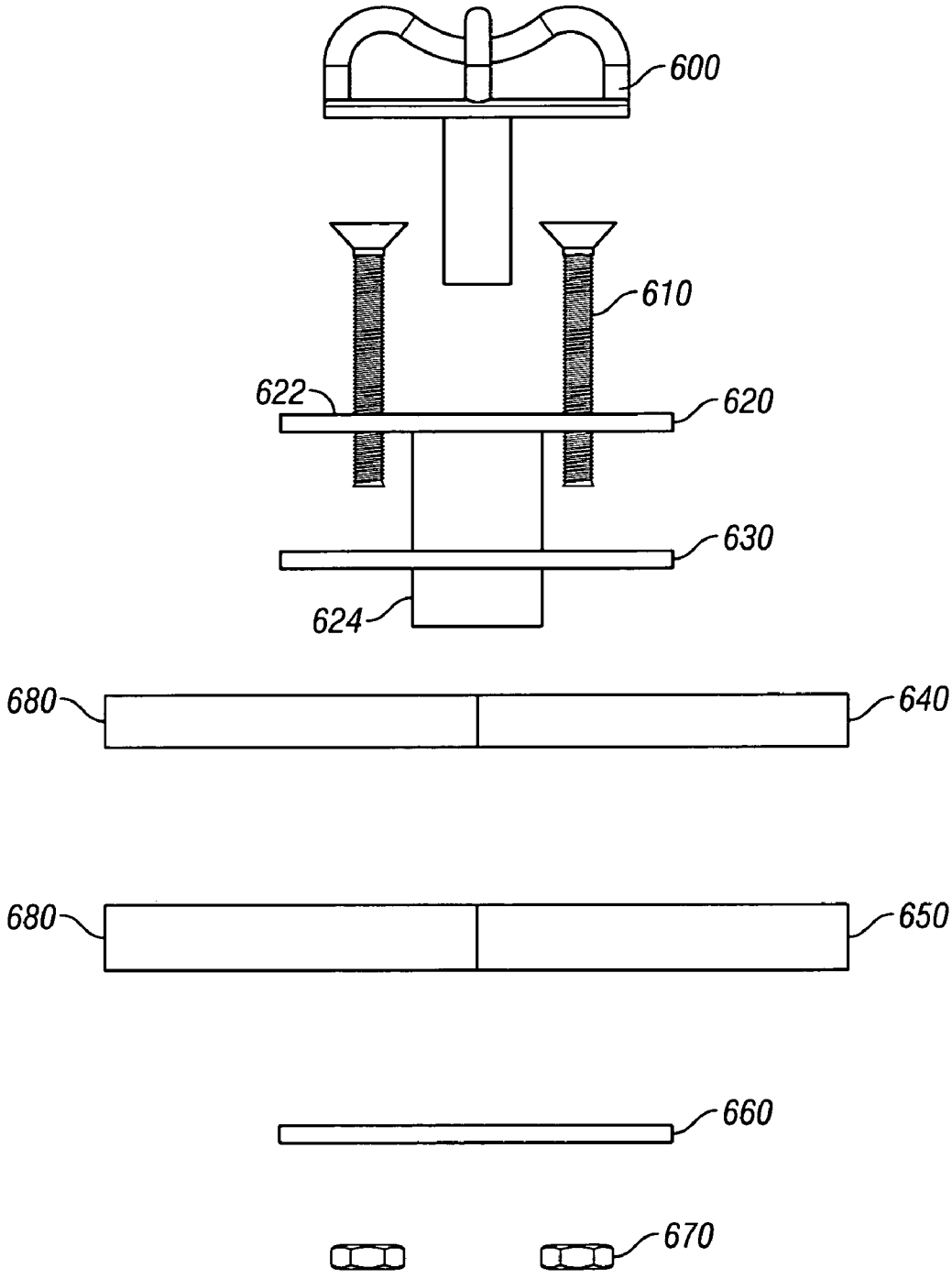
FIG. 8 is an exploded front view of the example watertight mount from FIG. 7.
Figure 9:
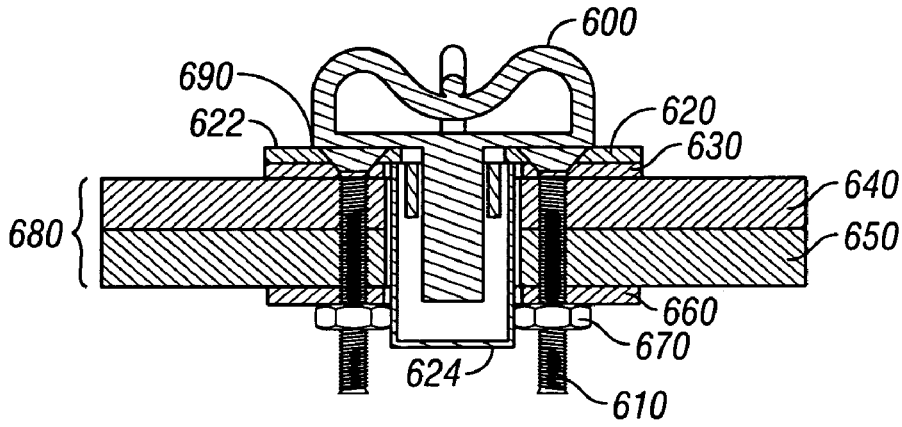
FIG. 9 is a front section view of the example watertight mount from FIG. 7.

FIG. 8 is an exploded front view of the example watertight mount from FIG. 7. FIG. 9 is a front section view of the example watertight mount from FIG. 7. The mount includes a connector top 600, a screw 610, a mounting base 620, a gasket 630, a base plate 660, and a nut 670. The watertight mount is installed in a spa wall 680, which includes a spa shell 640 (e.g., a molded plastic shell) and a reinforcement layer 650 (e.g., a layer of fiberglass reinforcement).

The mounting base 620 includes a flange 622 and a barrel shaped socket 624. The socket 624 resides entirely on one side of the flange 622, passing through the spa wall 680. The flange 622 has a top surface that is flat and includes a beveled opening as in FIG. 7. The screw 610 has a flat-topped beveled head such that the flat top of the screw head is substantially coplanar 690 with the top surface of the flange 622 when the screw 610 is tightened in place. In this context, substantially coplanar means the screw head is less than ten percent higher than the height of the flange 622 when the screw 610 is tightened in place. This allows the connector top 600 to be screwed down tight and provides a low profile when the connector top 600 is not in place.

Figure 10:
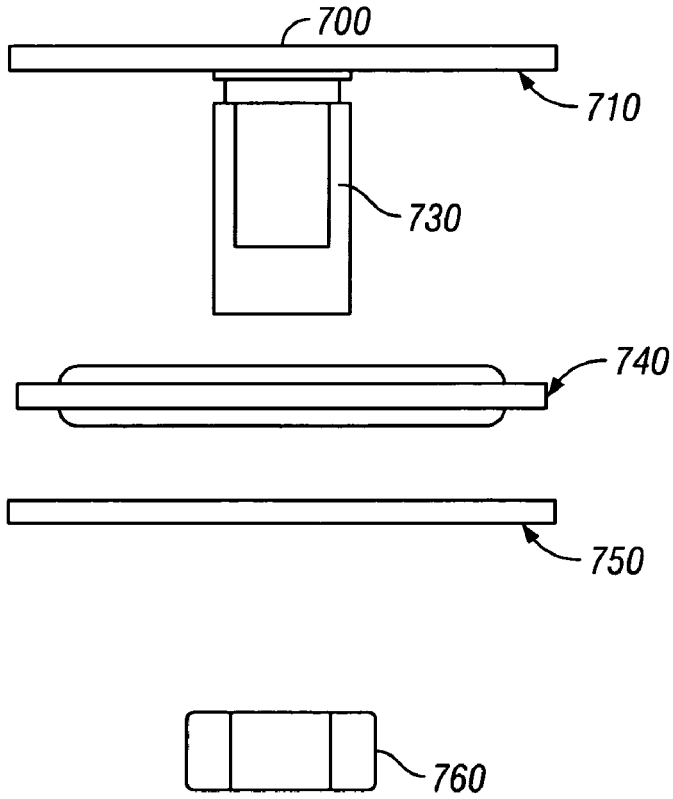
FIG. 10 is an exploded front view of another example watertight mount.

FIG. 10 is an exploded front view of another example watertight mount. The mount includes a mounting base 700, which includes a flange 710 and a barrel shaped socket 730. The socket 730 has securing threads on its exterior surface. These securing threads match a threaded hole in a nut 760. The nut 760 can be a standard nut as shown or a wing nut. A wing nut configuration allows for entirely tool free installation of the mounting system. The mount also includes a base plate 750 and an O-ring gasket 740.

Figure 11:
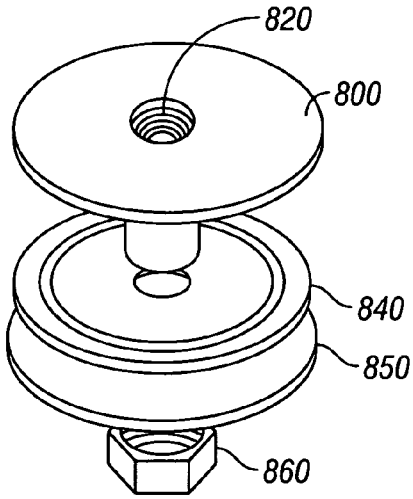
FIG. 11 is an exploded perspective view of the example watertight mount from FIG. 10.
Figure 12:
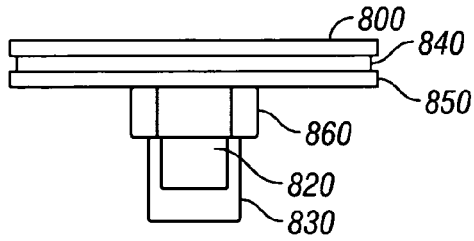
FIG. 12 is another front view of the example watertight mount from FIG. 10.

FIG. 11 is an exploded perspective view of the example watertight mount from FIG. 10. FIG. 12 is another front view of the example watertight mount from FIG. 10. The mount includes a mounting base 800, which includes a barrel shaped socket that has an interior surface 820 and an exterior surface 830. The exterior surface 830 has securing threads as before. Additionally, the interior surface 820 has mating threads built directly into the socket wall. The mating threads on the interior surface 820 match a threaded bolt. For example, the mating threads on the interior surface 820 may provide a ½×13 threaded base to match ½×13 threaded bolt.

The securing threads on the exterior surface 830 match a threaded hole in a nut 860. The mount also includes a base plate 850 and an O-ring gasket 840. In one implementation, the nut 860 is sufficient to provide at least twenty percent compression of the O-ring gasket 840. This can help to ensure an adequate seal for the installed mount.

Figure 13:
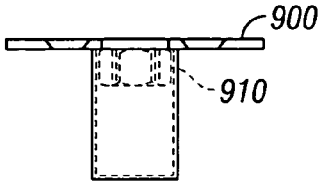
FIG. 13 is a front view of an example mounting base.

FIG. 13 is a front view of an example mounting base 900. The mounting base 900 can be used with each of the configurations described above and includes a nut 910 welded to the inside of the base 900. This nut 910 provides the mating threads described above. Thus, the nut 910 is part of the mounting base 900, and the interior surface of the nut 910 with the mating threads is an interior surface of the socket in the mounting base 900.

Figure 14:
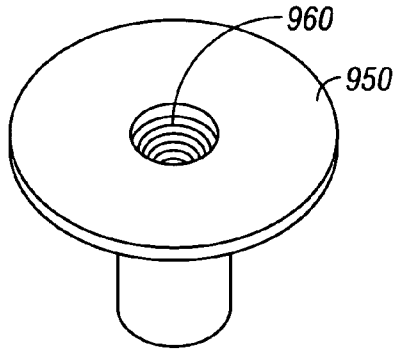
FIG. 14 is a perspective view of another example mounting base.

FIG. 14 is a perspective view of another example mounting base 950. The mounting base 950 can be used with each of the configurations described above and includes mating threads 960 built directly into an interior surface of the mounting base 950. This type of design (e.g., a solid barrel design) reduces the number of welds needed to construct the mounting base, and thus the mount overall as well. Reducing the number of welds in the mount can reduce the number of possible leak and corrosion points and can bring down production costs.

Figure 15:
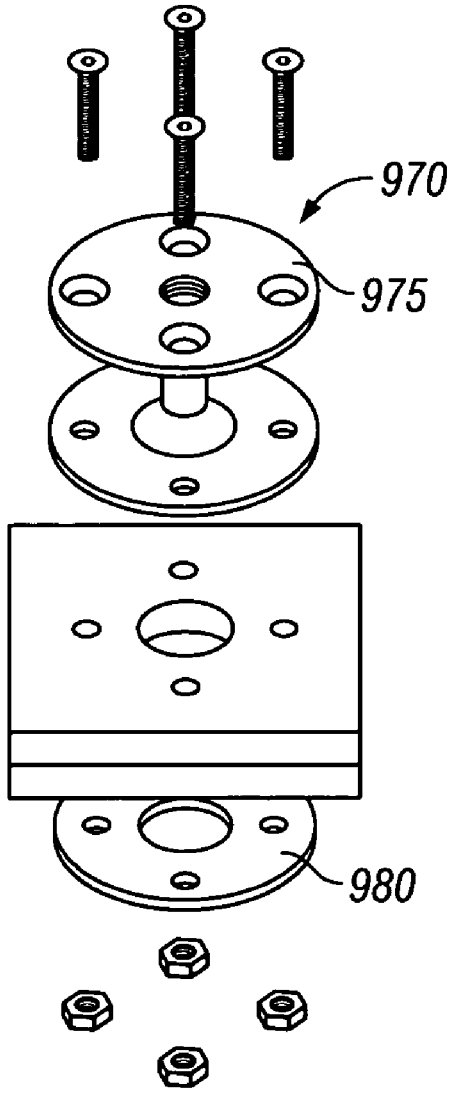
FIG. 15 is an exploded perspective view of another example watertight mount.
Figure 16:
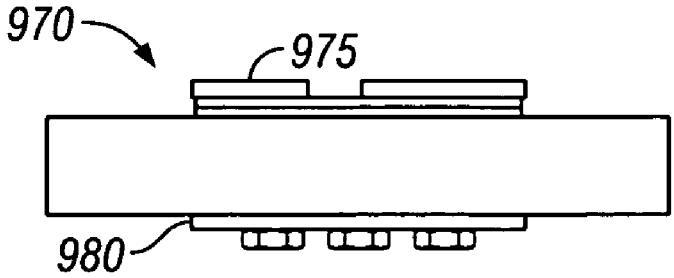
FIG. 16 is a front view of the example watertight mount from FIG. 15.

FIG. 15 is an exploded perspective view of another example watertight mount 970. FIG. 16 is a front view of the example watertight mount 970 from FIG. 15. The watertight mount 970 includes a mounting base 975 that has mating threads built directly into an interior surface of the mounting base 975. The mounting base 975 is coupled with a base plate 980 using a connector made up of four mounting screws and four nuts.

Figure 17:
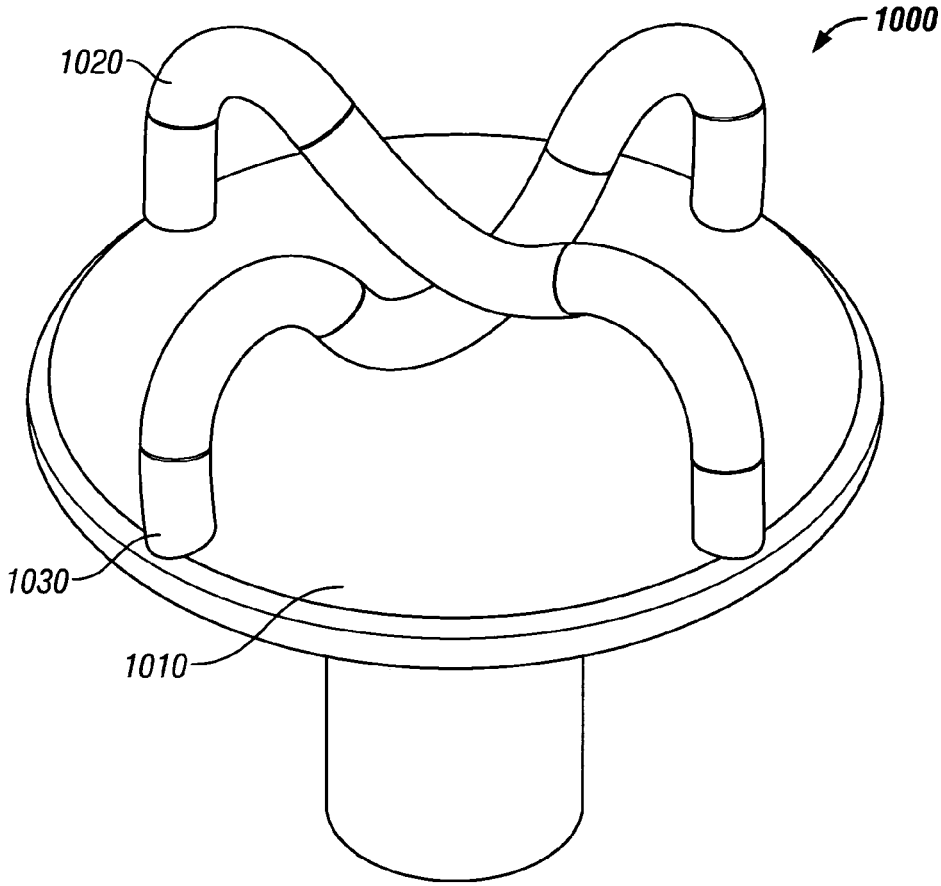
FIG. 17 is a perspective view of an example connector top.

FIG. 17 is a perspective view of an example connector top 1000. The connector top 1000 includes a flat upper surface 1010 and two anchors 1020, 1030. The two anchors 1020, 1030 are elongated and perpendicular with respect to each other. In addition, the anchor 1030 passes below the anchor 1020. In this example, the anchors 1020, 1030 are butterfly anchors that do not meet, thus an attached tether can slip between positions during use.

Figure 18:
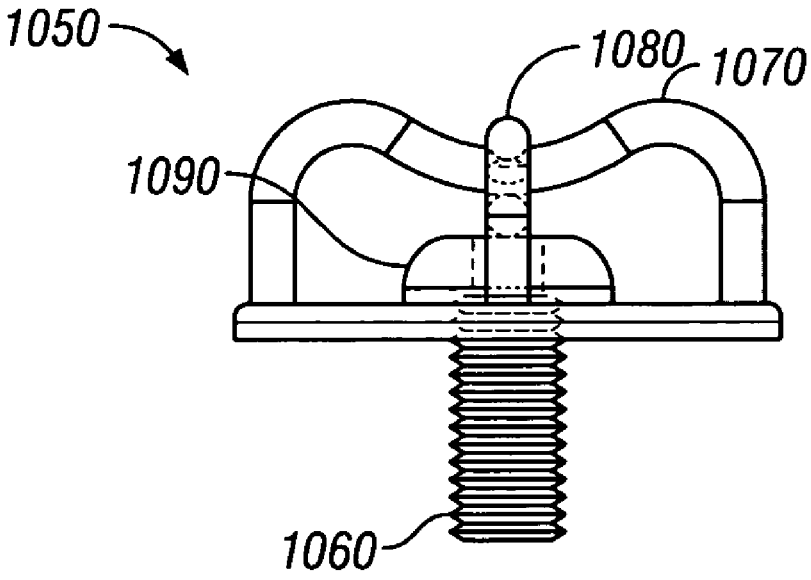
FIG. 18 is a front view of another example connector top.
Figure 19:
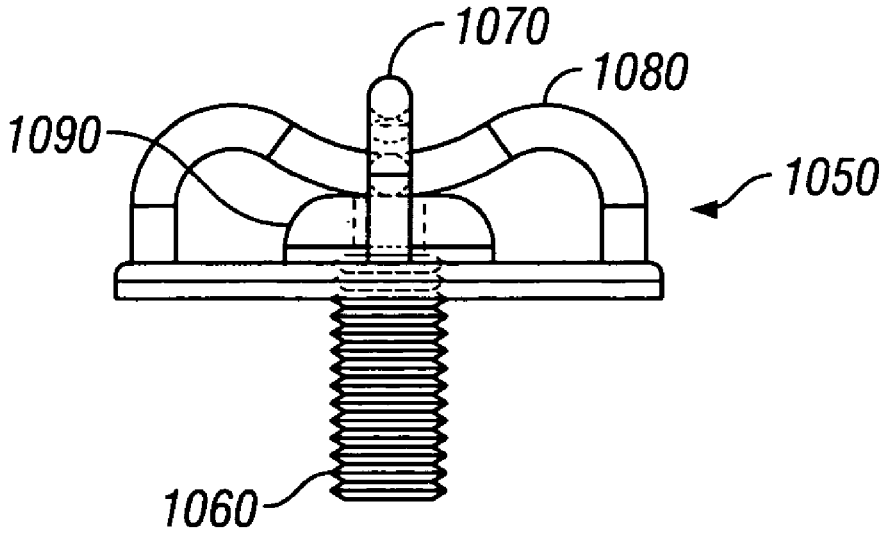
FIG. 19 is a front view of the connector top from FIG. 16, rotated ninety degrees.

FIG. 18 is a front view of another example connector top 1050. FIG. 19 is a front view of the connector top 1050 from FIG. 18, rotated ninety degrees. In this example, two anchors 1070, 1080 are once again butterfly anchors, but in this case they meet. Additionally, the lower anchor 1080 meets with a raised portion 1090 of the top surface of the connector top 1050. Thus, the two anchors 1070, 1080 effectively provide four separate anchoring points.

The mount tops can provide soft and safe use in an aquatic environment. The mount tops are user friendly and tool free. Some of their functionality includes resistance training, such as rowing and strength training with the use of curl bars, "D" handles, and other such exercise equipment. The mounting tops can be used in the mounting of exercise swim bars and various other pieces of exercise equipment. The versatility of the tops still allows for tether use while holding exercise bars firmly in place.

Figure 20:
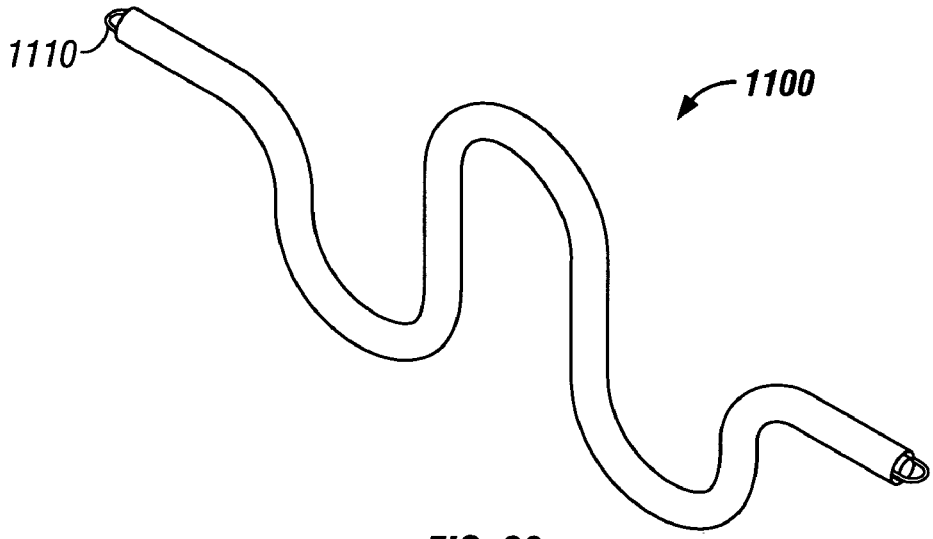
FIG. 20 is a perspective view of an example vertical grip exercise bar.
Figure 21:
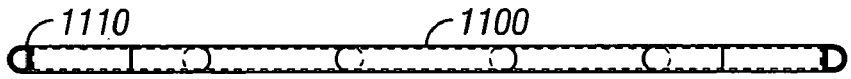
FIG. 21 is a top view of the vertical grip exercise bar from FIG. 20.
Figure 22:
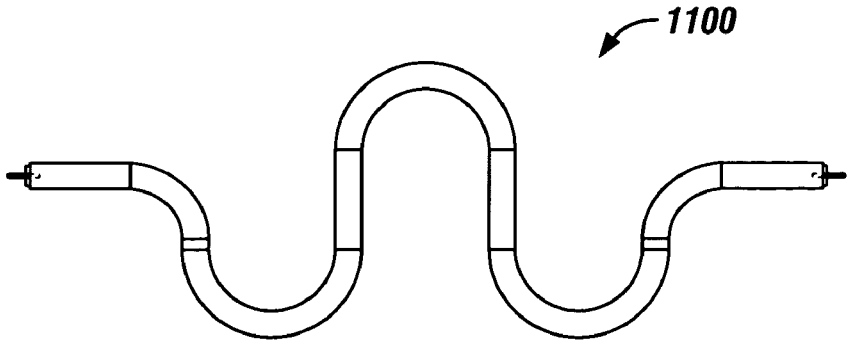
FIG. 22 is a front view of the vertical grip exercise bar from FIG. 20.

FIG. 20 is a perspective view of an example vertical grip exercise bar 1100. FIG. 21 is a top view of the vertical grip exercise bar 1100 from FIG. 20. FIG. 22 is a front view of the vertical grip exercise bar 1100 from FIG. 20. The vertical grip bar 1100 includes a single loop anchoring point 1110 that can be used to connect a tether for various exercise programs. The anchoring point 1110 can be a swiveling anchoring point and can include additional loops, such as described below.

Figure 23:
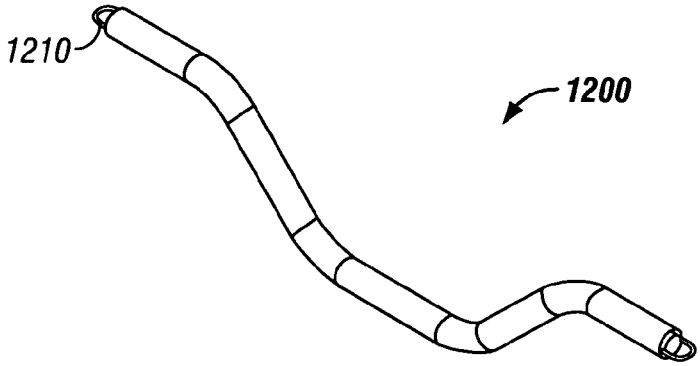
FIG. 23 is a perspective view of an example wave exercise bar.
Figure 24:
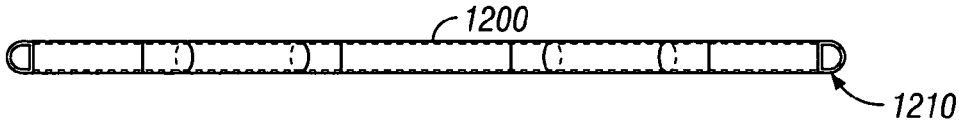
FIG. 24 is a top view of the wave exercise bar from FIG. 23.
Figure 25:
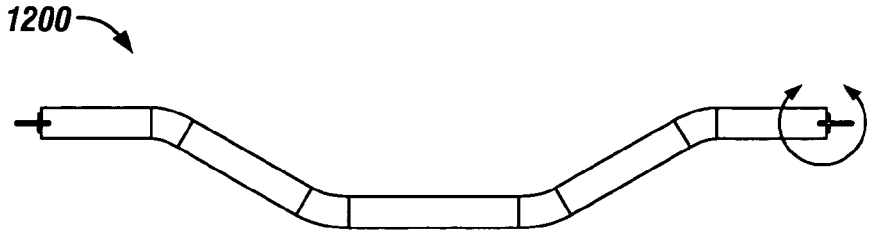
FIG. 25 is a front view of the wave exercise bar from FIG. 23.

FIG. 23 is a perspective view of an example wave exercise bar 1200. FIG. 24 is a top view of the wave exercise bar 1200 from FIG. 23. FIG. 25 is a front view of the wave exercise bar 1200 from FIG. 23. The wave exercise bar 1200 also includes a single loop anchoring point 1210 that can be used to connect a tether for various exercise programs. The anchoring point 1210 can include additional loops, such as described below.

Figure 26:
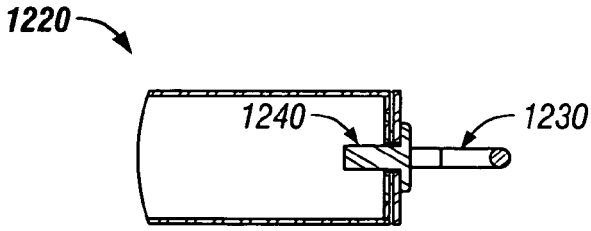
FIG. 26 is a magnified view of an example anchoring point.

FIG. 26 is a magnified view of an example anchoring point 1220. The anchoring point 1220 can be used with the exercise bars described above, or with other exercise bars, such as those described below. The anchoring point 1220 includes a rod 1230, which can have a single loop or multiple loops for attachment, and a retaining pin 1240 (e.g., a welded retaining pin). The retaining pint 1240 can allow the anchoring point 1220 to rotate freely on the end of the exercise bar, thus making the anchoring point 1220 a swiveling anchoring point.

Figure 27:
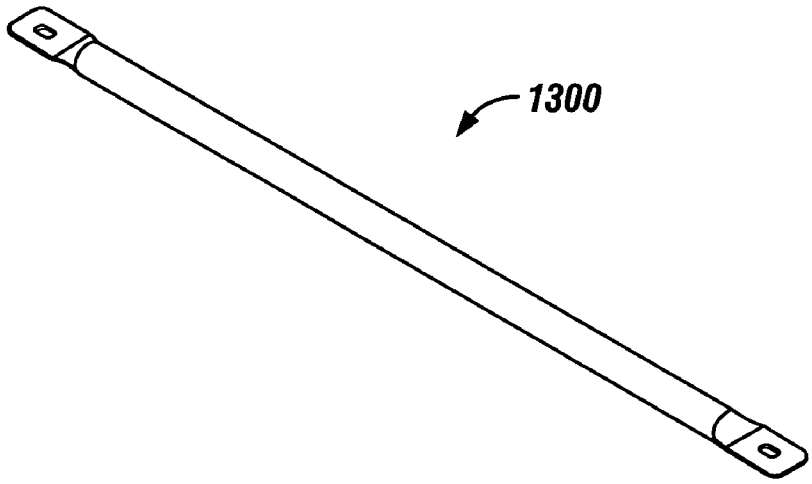
FIG. 27 is a perspective view of an example straight exercise bar.
Figure 28:
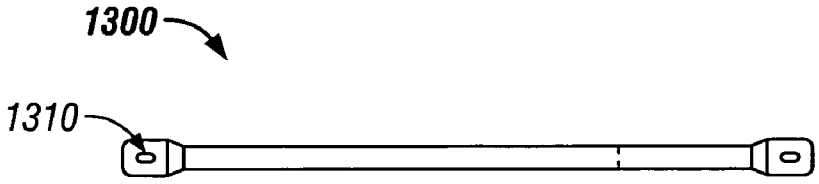
FIG. 28 is a top view of the straight exercise bar from FIG. 27.
Figure 29:
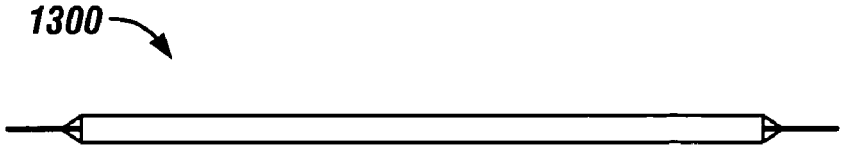
FIG. 29 is a front view of the straight exercise bar from FIG. 27.

FIG. 27 is a perspective view of an example straight exercise bar 1300. FIG. 28 is a top view of the straight exercise bar 1300 from FIG. 27. FIG. 29 is a front view of the straight exercise bar 1300 from FIG. 27. The straight exercise bar 1300 includes a static anchoring point 1310, which can be a flattened and pierced end of the bar. The static anchoring point can be used with other bars and at various angles to the normal position of the bar. The static anchoring point can be used to attach the bar 1300 and the other bars to a mount as described above, such as by screwing a connector top down onto the static anchoring point.

Figure 30:
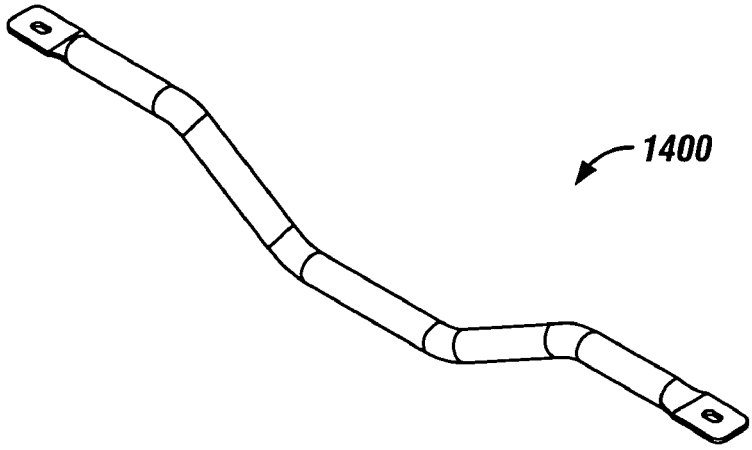
FIG. 30 is a perspective view of an example bent exercise bar.
Figure 31:
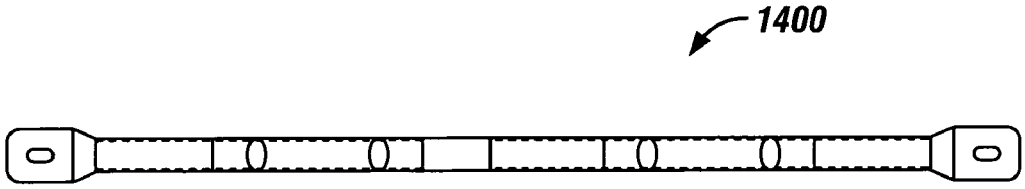
FIG. 31 is a top view of the bent exercise bar from FIG. 30.
Figure 32:
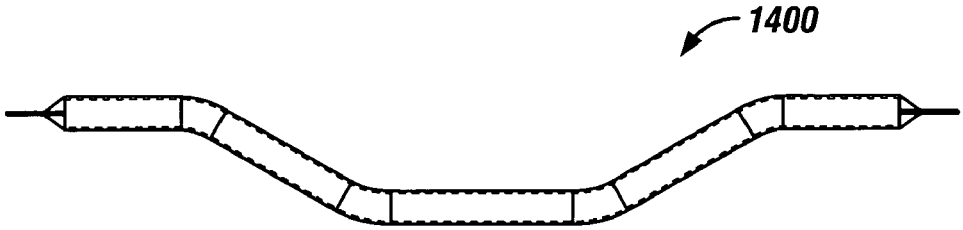
FIG. 32 is a front view of the bent exercise bar from FIG. 30.

FIG. 30 is a perspective view of an example bent exercise bar 1400. The bar 1400 includes a 30° bend to assist in various exercise routines. FIG. 31 is a top view of the bent exercise bar 1400 from FIG. 30. FIG. 32 is a front view of the bent exercise bar 1400 from FIG. 30.

Figure 33:
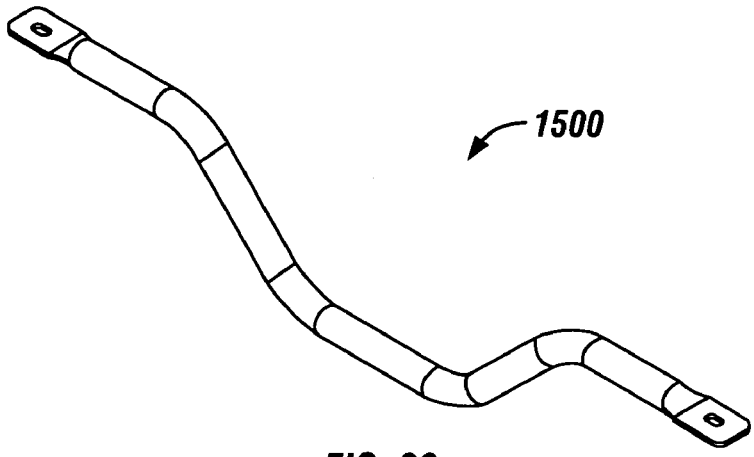
FIG. 33 is a perspective view of another bent exercise bar.
Figure 34:
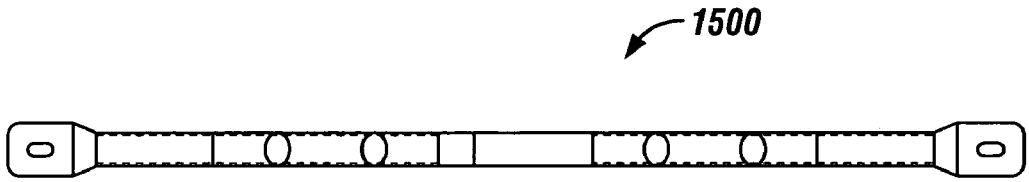
FIG. 34 is a top view of the bent exercise bar from FIG. 33.
Figure 35:
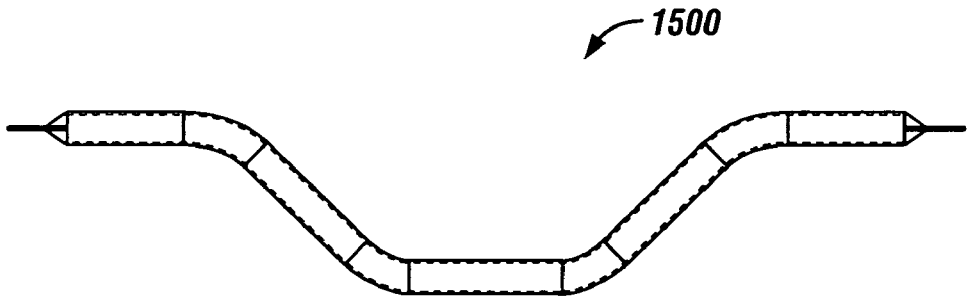
FIG. 35 is a front view of the bent exercise bar from FIG. 33.

FIG. 33 is a perspective view of another bent exercise bar 1500. The bar 1500 includes a 45° bend to assist in various exercise routines. FIG. 34 is a top view of the bent exercise bar 1500 from FIG. 33. FIG. 35 is a front view of the bent exercise bar 1500 from FIG. 33.

Figure 36:
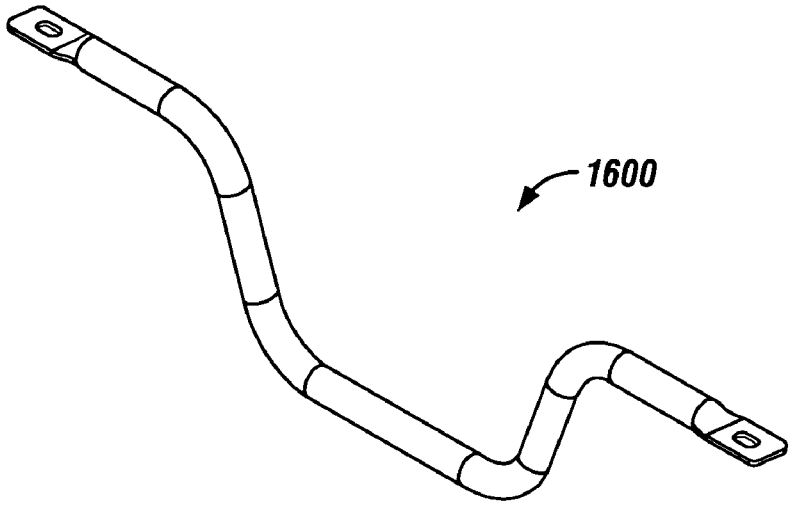
FIG. 36 is a perspective view of another bent exercise bar.
Figure 37:
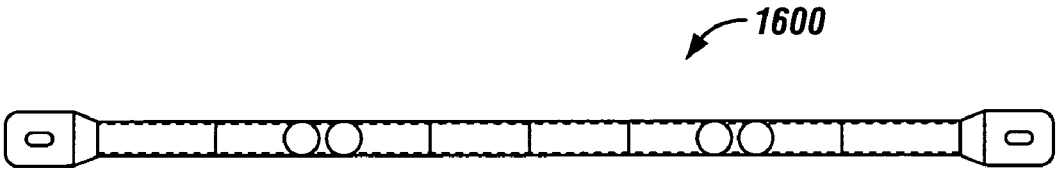
FIG. 37 is a top view of the bent exercise bar from FIG. 36.
Figure 38:
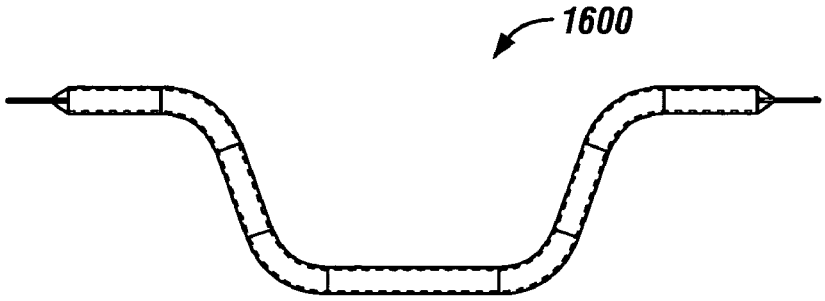
FIG. 38 is a front view of the bent exercise bar from FIG. 36.

FIG. 36 is a perspective view of another bent exercise bar 1600. The bar 1600 includes a 70° bend to assist in various exercise routines. FIG. 37 is a top view of the bent exercise bar 1600 from FIG. 36. FIG. 38 is a front view of the bent exercise bar 1600 from FIG. 36.

The exercise bars described above are reversible. Moreover, the exercise bars described in connection with FIGS. 28-36 are designed at 30, 45, and 70-degree angles. Other angles are also possible to provide for a variety of hydrotherapy programs.

Figure 39:
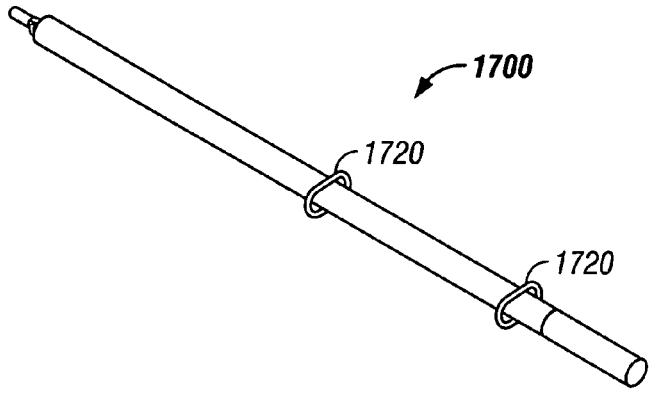
FIG. 39 is a perspective view of an example reversible rower having multiple tether attachment points.
Figure 40:
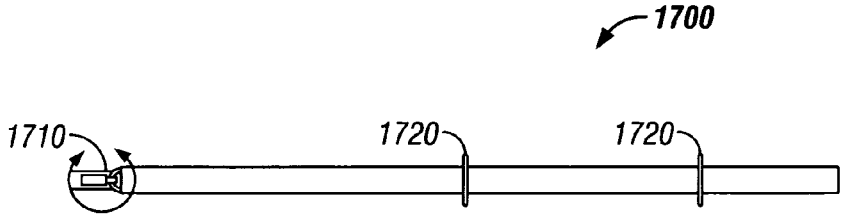
FIG. 40 is a top view of the reversible rower from FIG. 39.

FIG. 39 is a perspective view of an example reversible rower 1700 having multiple tether attachment points 1720. FIG. 40 is a top view of the reversible rower 1700 from FIG. 39. The rower 1700 may have two or more locations, such as the attachment points 1720, to mount resistance tethers. By allowing a user to attach multiple tethers to different points along a rowing oar, resistance levels may be varied in a more flexible manner for resistance training. The rowers can be used with either horizontal or vertical mounts, and in either a seated or a standing position, for a variety of hydrotherapy exercises.

Figure 41:
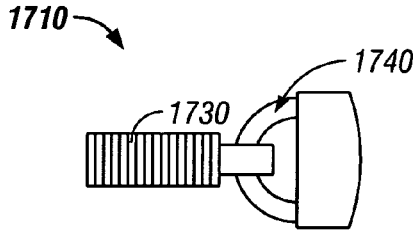
FIG. 41 is a magnified view of an example anchoring point.

Example rowers may be 38-inch×1.25-inch stainless steel (or other suitable material) and may have an end design specific to the mounting system described here. For example, the rower 1700 includes an anchoring point 1710. FIG. 41 is a magnified view of an example anchoring point 1710. This anchoring point 1710 includes a "D" ring 1740 and a threaded bolt 1730.

Figure 42:
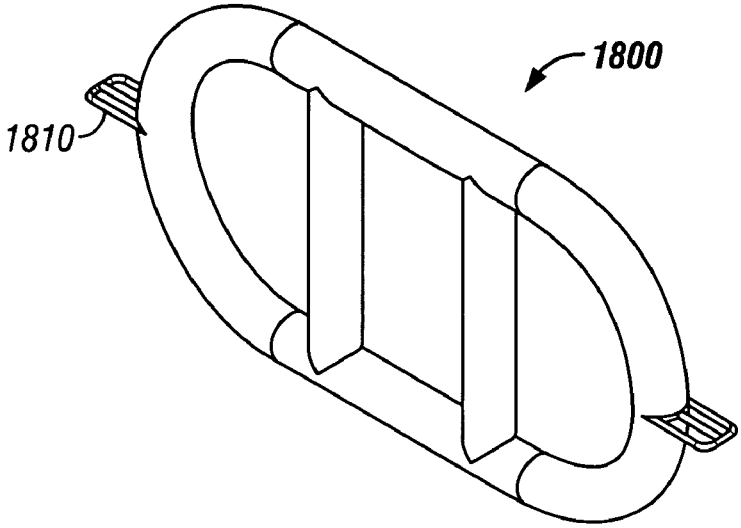
FIG. 42 is a perspective view of an example exercise bar.
Figure 43:
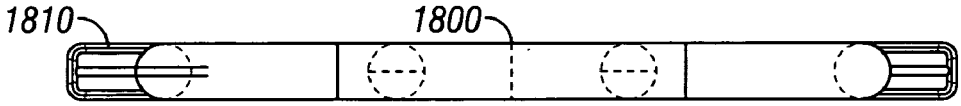
FIG. 43 is a top view of the example exercise bar from FIG. 42.
Figure 44:
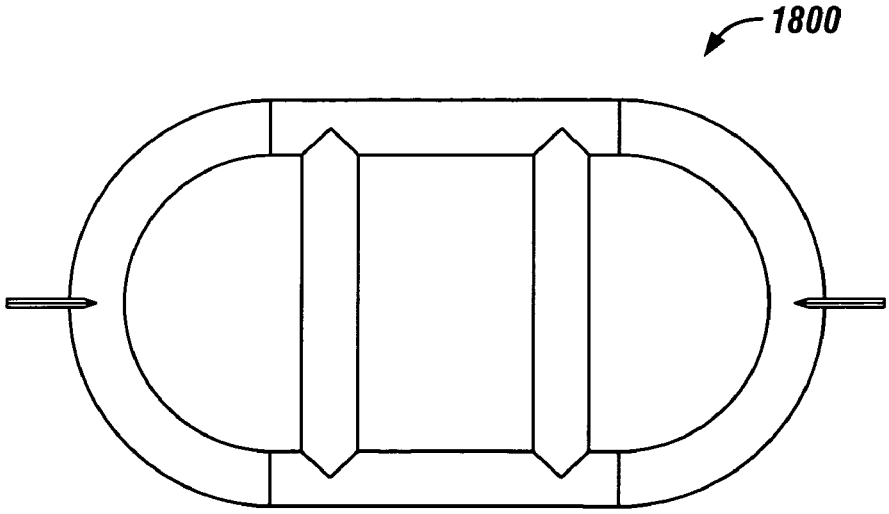
FIG. 44 is a front view of the example exercise bar from FIG. 42.

FIG. 42 is a perspective view of an example exercise bar 1800. FIG. 43 is a top view of the example exercise bar 1800 from FIG. 42. FIG. 44 is a front view of the example exercise bar 1800 from FIG. 42. The exercise bar 1800 includes double loop anchoring point 1810, which can be a swiveling anchoring point, such as described above. Multiple tethers can be attached to this double loop anchoring point 1810.

Figure 45:
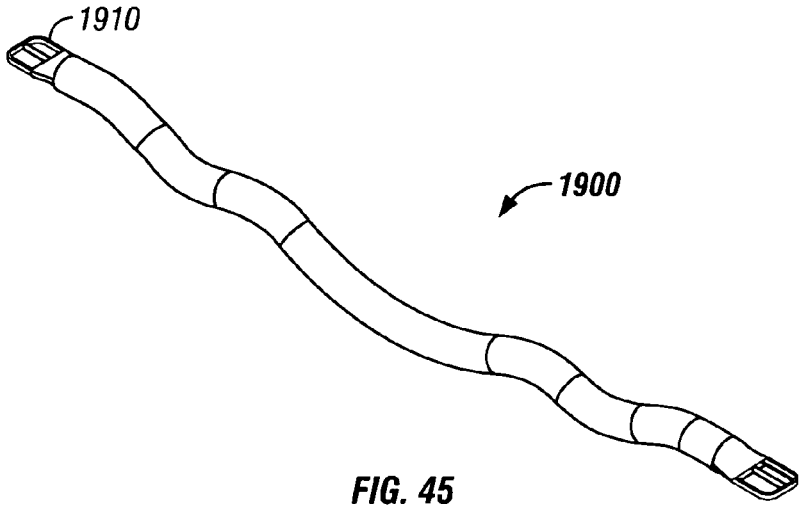
FIG. 45 is a perspective view of an example exercise bar.
Figure 46:
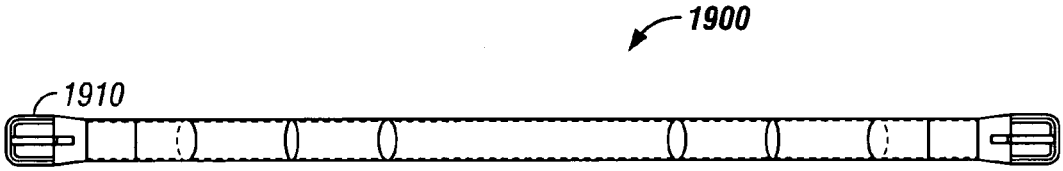
FIG. 46 is a top view of the example exercise bar from FIG. 45.
Figure 47:
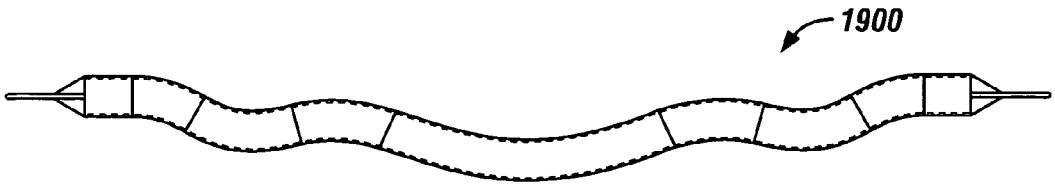
FIG. 47 is a front view of the example exercise bar from FIG. 45.

FIG. 45 is a perspective view of an example exercise bar 1900. FIG. 46 is a top view of the example exercise bar 1900 from FIG. 45. FIG. 47 is a front view of the example exercise bar 1900 from FIG. 45. The exercise bar 1900 also has a double loop anchoring point 1910.

In addition to the exercise bars described above, multiple other exercise bars of various shapes and sizes can be provided for use with the mounting system and resistance tethers. These exercise bars also can allow for multiple tether attachment in two directions. This allows a work/work condition as opposed to a work/rest condition. The aquatic exercise bars may be stainless steel, may be 1.25 or 1.5 inches in diameter and may be designed in a variety of lengths (e.g., 12, 24 and 36 inches) or a single standard length (e.g., 42 inches). The aquatic exercise bars can be used to perform various exercises such as curls, bench press, lifts, etc.

The exercise bars are a versatile system of exercise equipment that can be adapted to various user needs and the use of hydrotherapy exercise. The bars can be designed to work specifically with the mounting system described here or to work with both the mounting system described and with other mounting systems. These bars can be part of the hydrotherapy exercise system and can be used to perform resistance style aquatic circuit training hydrotherapy when used with the mounting system described here, either with the tethers as described above or with traditional weights.

While various embodiments are shown above and in the accompanying drawings, these embodiments are presented by way of example only. Other embodiments may be within the scope of the following claims.

What is claimed is:

1. A hydrotherapy exercise system comprising:

a swim spa including a partitioning wall having an interior surface and an opposite surface, the interior surface being shaped to contain water in the swim spa;

a plurality of multi-use watertight mounts installed in the partitioning wall, each mount comprising a mounting base including a flange and a recessed socket passing through the partitioning wall and having an interior surface including mating threads, a gasket adjoining the flange and the interior surface of the partitioning wall, and a base plate adjoining the opposite surface of the partitioning wall and coupled with the mounting base; and exercise equipment that includes threaded bolts, where each threaded bolt matches the mating threads of the recessed sockets in the multi-use watertight mounts, wherein the exercise equipment comprises multiple rowers, each of the rowers comprising multiple tether attachment points that provide tether attachment configurations for both variable resistance levels and bi-directional resistance.

2. The system of claim 1, wherein the exercise equipment further comprises multiple connector tops, each of the connector tops comprising:

a rigid body;

two or more anchors coupled with the rigid body; and a threaded bold coupled with the rigid body.

3. The system of claim 2, wherein the exercise equipment further comprises multiple exercise bars, each of the exercise bars comprising two swivel anchoring points, each of the two swivel anchoring points comprising one or more loops.

4. The system of claim 3, wherein the exercise equipment further comprises multiple additional exercise bars, each of the additional exercise bars comprising two static anchoring points.

5. The system of claim 1, wherein the partitioning wall includes multiple bolsters, and a portion of the plurality of multi-use watertight mounts are installed in the bolsters.

6. The system of claim 5, wherein the plurality of multi-use watertight mounts are installed in a uniformly spaced fashion.

7. A hydrotherapy exercise system comprising:

a swim spa including a partitioning wall having an interior surface and an opposite surface, the interior surface being shaped to contain water in the swim spa;

a plurality of multi-use watertight mounts installed in the partitioning wall, each mount comprising a mounting base including a flange and a recessed socket passing through the partitioning wall and having an interior surface including mating threads, a gasket adjoining the flange and the interior surface of the partitioning wall, and a base plate adjoining the opposite surface of the partitioning wall and coupled with the mounting base; and exercise equipment that includes threaded bolts, where each threaded bolt matches the mating threads of the recessed sockets in the multi-use watertight mounts, wherein the exercise equipment comprises means for performing multiple exercises using variable resistance and multiple attachment configurations.

8. A hydrotherapy exercise system comprising:

a tub including a partitioning wall having an interior surface and an opposite surface, the interior surface being shaped to contain water in the tub;

a plurality of multi-use watertight mounts installed in the partitioning wall, each mount comprising a mounting base including a flange and a socket passing through the partitioning wall and having an interior surface including mating threads, and a base plate adjoining the opposite surface of the partitioning wall and coupled with the mounting base; and exercise equipment that includes at least one threaded bold that matches the mating threads of the recessed sockets in the multi-use watertight mounts, wherein the exercise equipment comprises a rower comprising multiple tether attachment points that provide tether attachment configurations for both variable resistance levels and bi-directional resistance.

9. The system of claim 8, wherein the flange comprises a rounded flange, and the base plate comprises a rounded base plate having width dimensions substantially to width dimensions of the rounded flange.

10. The system of claim 9, wherein the rounded flange has a width of at least three inches, and the rounded base plate has a width of at least three inches.

11. The system of claim 8, wherein the partitioning wall includes multiple bolsters, and a portion of the plurality of multi-use watertight mounts are installed in the bolsters.

12. The system of claim 11, wherein the plurality of multi-use watertight mounts are installed in a uniformly spaced fashion.

13. The system of claim 8, wherein the tub comprises a swim spa.

14. The system of claim 8, wherein the tub comprises a spa.

15. The system of claim 8, wherein the tub comprises a pool.

16. A hydrotherapy exercise system comprising:

a tub including a partitioning wall having an interior surface and an opposite surface, the interior surface being shaped to contain water in the tub;

a plurality of multi-use watertight mounts installed in the partitioning wall, each mount comprising a mounting base including a flange and a socket passing through the partitioning wall and having an interior surface including mating threads, and a base plate adjoining the opposite surface of the partitioning wall and coupled with the mounting base; and exercise equipment that includes at least one threaded bold that matches the mating threads of the recessed sockets in the multi-use watertight mounts, wherein the exercise equipment comprises a connector top comprising:

a rigid body;

two or more anchors coupled with the rigid body; ad a threaded bold coupled with the rigid body.

17. The system of claim 16, wherein the rigid body includes a bottom surface comprising a flat surface.

18. The system of claim 17, wherein the anchor comprises a first anchor, the connector top further comprising a second anchor coupled with the rigid body.

19. The system of claim 18, wherein the first anchor and the second anchor are perpendicular with respect to each other, the first anchor positioned below the second anchor such that the first anchor passes through a region defined by the second anchor and a top surface of the rigid body.

20. The system of claim 19, wherein the first anchor and the second anchor each have a butterfly shape.

21. The system of claim 18, wherein the first anchor meets the second anchor such that the second anchor is divided into two anchoring points.

22. The system of claim 16, wherein the exercise equipment further comprising multiple exercise bars, each of the exercise bars comprising two swivel anchoring points, each of the two swivel anchoring points comprising one or more loops.

23. The system of claim 22, wherein the exercise equipment further comprises multiple additional exercise bars, wherein the exercise equipment further comprises multiple additional exercise bars, each of the additional exercise bars comprising two static anchoring points.

24. A hydrotherapy exercise system comprising:

a tub including a partitioning wall having an interior surface and an opposite surface, the interior surface being shaped to contain water in the tub;

a plurality of multi-use watertight mounts installed in the partitioning wall, each mount comprising a mounting base including a flange and a socket passing through the partitioning wall and having an interior surface including mating threads, and a base plate adjoining the opposite surface of the partitioning wall and coupled with the mounting base; and exercise equipment that includes at least one threaded bold that matches the mating threads of the recessed sockets in the multi-use watertight mounts, wherein the exercise equipment comprises means for performing multiple exercises using variable resistance and multiple attachment configurations.

* * * * *

UNITED STATES PATENT AND TRADEMARK OFFICE

CERTIFICATE OF CORRECTION

PATENT NO. : 7,597,652 B2
APPLICATION NO. : 10/211078
DATED : October 6, 2009
INVENTOR(S) : Walker et al.

It is certified that error appears in the above-identified patent and that said Letters Patent is hereby corrected as shown below:

Column 10, line 17, replace the word "bold" with "bolt";
Column 10, line 61, replace the word "bold" with "bolt";
Column 11, line 3, insert the word --similar-- between the words "substantially" and "to";
Column 11, line 30, replace the word "bold" with the word "bolt";
Column 11, line 35, replace the word "ad" with the word "and";
Column 11, line 36, replace the word "bold" with the word "bolt"; and
Column 12, line 34, replace the word "bold" with the word "bolt".

Signed and Sealed this

Twenty-second Day of December, 2009

David J. Kappos

David J. Kappos
*Director of the United States Patent and Trademark Office*